US005862769A

United States Patent [19]

Anderson

[11] Patent Number: 5,862,769

[45] Date of Patent: Jan. 26, 1999

[54] MODIFIED WINDSURF BOOM

[76] Inventor: Steven C. Anderson, 1411 Juniper Mt. Rd., Olympic Valley, Calif. 96146

[21] Appl. No.: 931,388

[22] Filed: Sep. 16, 1997

[51] Int. Cl.[6] ..... B63B 35/79

[52] U.S. Cl. ..... 114/39.2; 114/97

[58] Field of Search ..... 114/39.1, 39.2, 114/102, 103, 97, 98, 115

[56] References Cited

FOREIGN PATENT DOCUMENTS 2900908 7/1980 Germany ..... 114/97

*Primary Examiner*—Stephen Avila

[57] ABSTRACT

This invention modifies a windsurfing boom, to allow the clew of a windsurfing sail to move laterally away from the sailor. An elongated tail piece and roller assembly are used to facilitate movement of said sail.

2 Claims, 3 Drawing Sheets

MODIFIED WINDSURF BOOM

FIELD OF INVENTION

This invention is directed towards windsurfing booms. This invention allows the clew of a windsurfing sail to move laterally away from the sailor, and allows the outhaul tension of said sail to increase as the wind gets stronger.

BACKGROUND ART

Until now, all windsurfing booms have a tailpiece that fixes the clew of a sail in essentially one position , relative to the sailor. I have thought for some time that a windsurf sail would have better shape if it was allowed to move laterally away from the sailor. I built a device to tested the concept.

After two months of testing I found the following results:

1. the sail is more manageable in overpowering conditions.
2. the sailboard goes upwind better.
3. the sailboard goes faster.

I'm not an aerodynamic engineer. I can't explain why I'm getting these results. But I feel that the sail has better shape if the clew is positioned further away from the sailor than current windsurfing booms now allow. It is well known that enlarging the outhaul, flattens the sail and makes it perform better in overpowering conditions.

OBJECTS AND ADVANTAGES

The object of this device is to provide a windsurfing boom that will allow a windsurfing sail to have a better shape.

Another object is to automatically increase outhaul tension on said sail as wind speed increases.

BRIEF DESCRIPTION OF THE DRAWINGS

In the accompanying drawings which form a part hereof and wherein like numbers of reference refer to similar parts throughout.

LIST OF REFERENCE NUMERALS

10. Sail Mast
11. Boom Arm
12. Sail
13. Elongated Tail Piece
14. Roller Mechanism
15. Clew of Sail 10
21. Grommet in Clew of Sail 10
22. Rope attached to Grommet 21
23. Jam Cleats
24. Rivet
26. Rivet through Roller 27

27. Roller
28. Sleeve for Rivet 24
29. Sleeve for Rivet 26
32. Arced Elongated Tail Piece

DESCRIPTION OF THE PREFERRED EMBODIMENT

Figure 1:
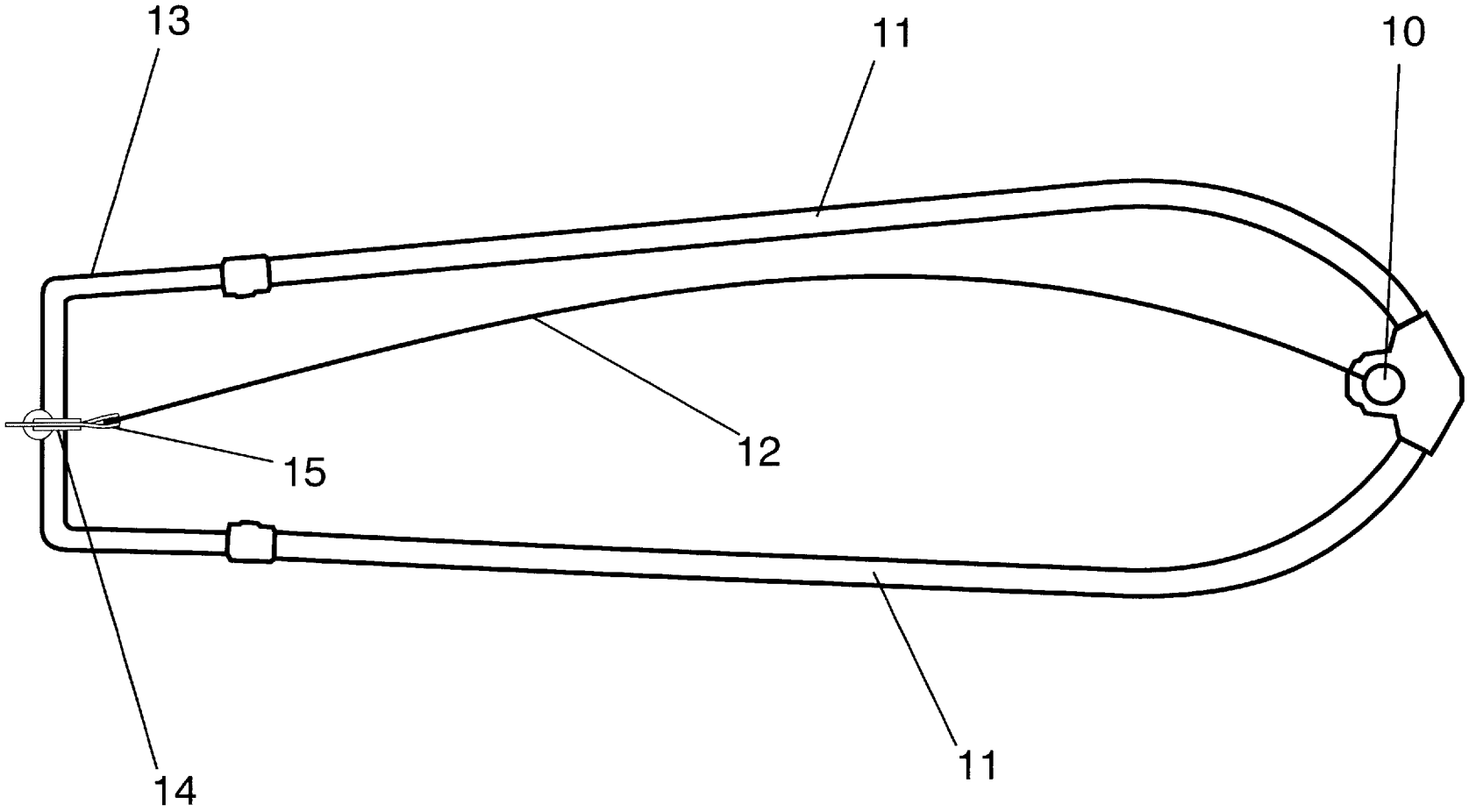
FIG. 1 shows a top view of the Modified Windsurfing Boom.

Referring to FIG. 1. Elongated Tail Piece 13 made of aluminum tubing is welded to the rear section of a windsurfing boom (I used a "Chinook" adjustable boom). I have experimented with lengths from 7" to 12" for Elongated Tail Piece 13.

Figure 2:
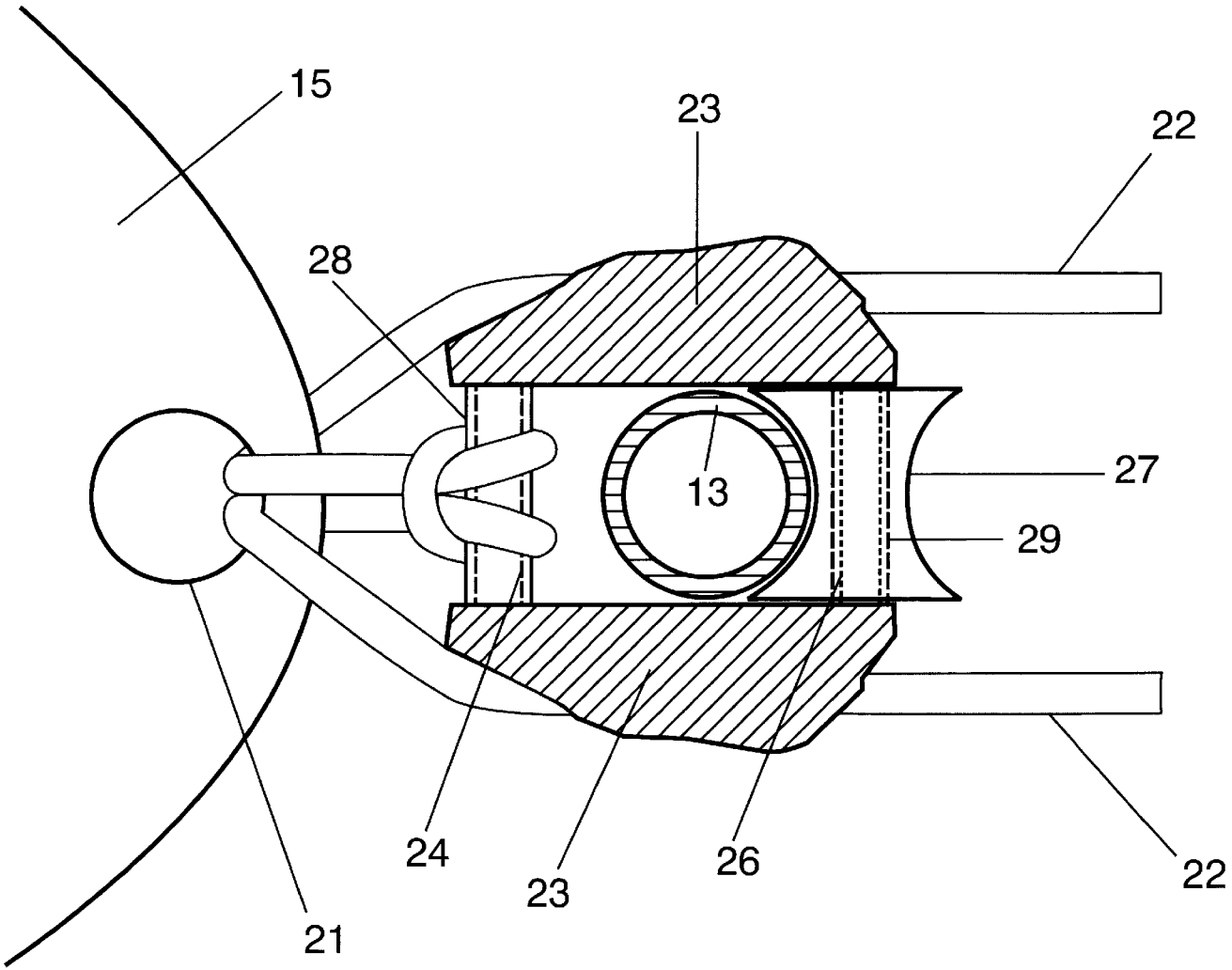
FIG. 2 shows a cross section of Elongated Tail Piece 13 and Roller Mechanism 14 which allows the clew of a windsurfing sail to move laterally away from the sailor.

Roller Mechanism 14 is constructed as shown in FIG. 2 ,and fitted around Elongated Tail Piece 13 as shown in FIG. 2.

Sail 12 is then rigged on Mast 10 and the Modified Boom is secured to Mast 10 in the conventional manner. The Modified Boom is then adjusted to the proper length for the sail being used by the adjustments in the boom.

Rope 22 is tied to Grommet 21. Sail 12 is then outhauled by securing both ends of Rope 22 in Cleats 23 as shown in FIG. 2.

The Modified Boom is now ready for use by the sailor. The sailor uses the boom in the conventional manner. The only difference is that as wind fills the sail, the force of the wind will move the sail away from the sailor.

Figure 3:
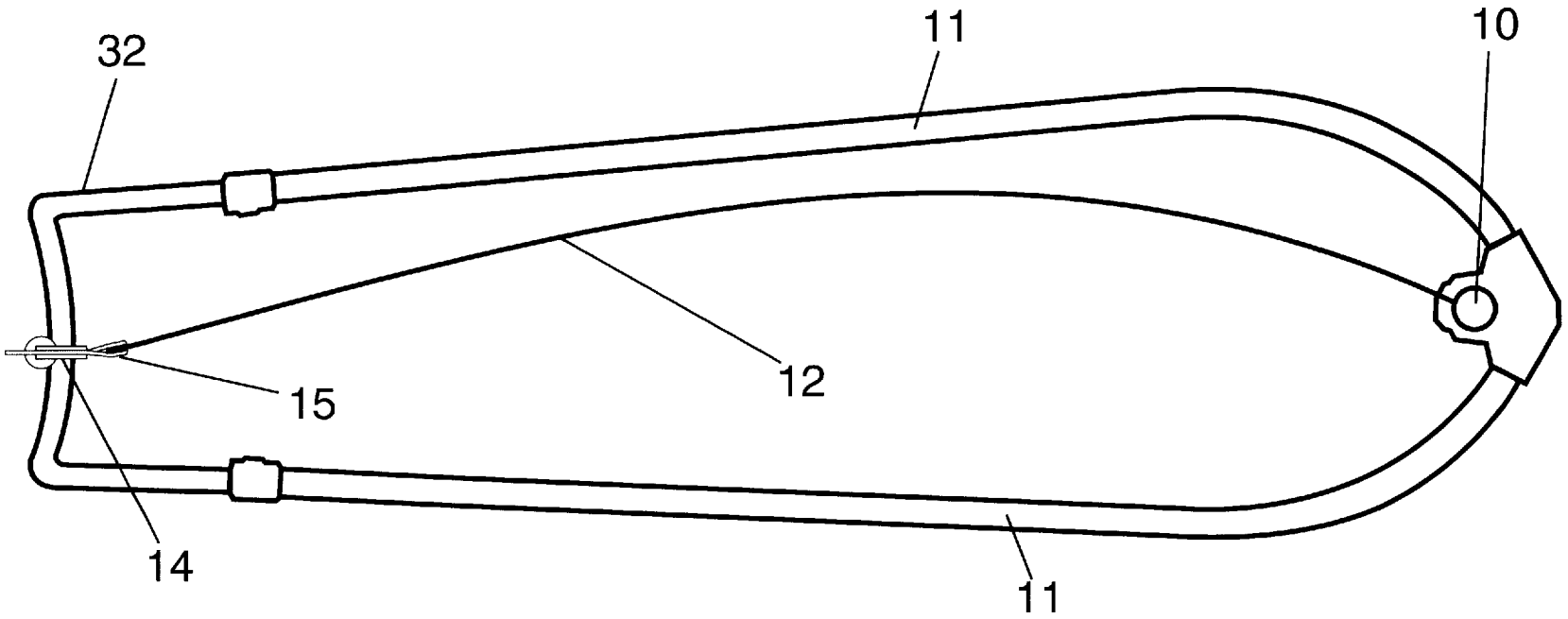
FIG. 3 shows an alternative version of the elongated tail piece. Tail Piece 32 is aluminum tubing that has an arc. The distance between Mast 10 and the arced elongated tail piece is shortest in the middle of arced Elongated Tail Piece 32. Therefore when there is no force on Sail 12, Clew 15 will come to rest in the middle of Boom Arms 11. As Sail 12 is filled with wind, Clew 15 moves away from the sailor and the distance between Mast 10 and Clew 15 becomes greater and therefore Sail 12 is outhauled more and flattened.

Referring to FIG. 3. If Tail Piece 32 is used, the arc will serve two purposes. 1: Sail 12 will return to a center position when there is no force on Sail 12. 2: as the force on Sail 12 makes the clew move away from the sailor the outhaul tension on Sail 12 will increase, thus flattening Sail 12 out and making Sail 12 more controllable in higher winds.

While the invention has been described in conjunction with specific embodiments thereof, it is evident that many alternatives, modifications, and variations will be apparent to those skilled in the art in light of the foregoing description. For example, instead of using a roller mechanism, a track could be secured to Elongated Tail Piece 13, and a slider on said track could be attached to Grommet 21. The clew of the sail could the move along the track. Accordingly, it is intended to embrace all such alternatives, modifications, and variations as fall within the spirit and broad scope of the appended claims.

I claim:

1. A windsurfing boom apparatus comprising:

a boom having a longitudinal axis, the boom having an elongated tailpiece generally perpendicular to the longitudinal axis of the boom; and, said boom having a device to attach the boom directly to the clew of the sail at the rear edge of the sail, said device having means to travel along the tailpiece to allow the clew of the sail to move laterally toward or away from the longitudinal axis of the boom and thus toward or away from a sailor.

2. A windsurfing boom apparatus comprising:

a boom having a longitudinal axis, the boom having an elongated tailpiece generally perpendicular to the longitudinal axis of the boom;

the tailpiece being bent toward the mast; and, said boom having a device to attach the boom directly to the clew of the sail at the rear edge of the sail, said device having means to travel along the bent tailpiece to allow the clew of the sail to move laterally toward or away from the longitudinal axis of the boom and thus toward or away from a sailor.

* * * * *